US005673450A

United States Patent [19]

Briscoe

[11] Patent Number: 5,673,450

[45] Date of Patent: Oct. 7, 1997

[54] BRUSH PRESSURE SYSTEM

[76] Inventor: William Anthony Briscoe, Wades House, Winchester, Hampshire, United Kingdom

[21] Appl. No.: 446,861

[22] PCT Filed: Nov. 17, 1994

[86] PCT No.: PCT/GB94/02528

§ 371 Date: Aug. 7, 1995

§ 102(e) Date: Aug. 7, 1995

[87] PCT Pub. No.: WO95/13737

PCT Pub. Date: May 26, 1995

[30] Foreign Application Priority Data

| | | | |
|---|---|---|---|
| Nov. 17, 1993 | [GB] | United Kingdom | 9323718 |
| Jun. 10, 1994 | [GB] | United Kingdom | 9411655 |
| Nov. 7, 1994 | [GB] | United Kingdom | 9422442 |

[51] Int. Cl.[6] ..... A47L 11/16; A47L 11/24

[52] U.S. Cl. ..... 15/49.1; 15/87; 451/353

[58] Field of Search ..... 15/49.1, 50.1, 15/50.2, 52.2, 87, 385, 358, 359, 370, 371; 451/353; 341/155

[56] References Cited

U.S. PATENT DOCUMENTS

| | | | |
|---|---|---|---|
| 3,496,681 | 2/1970 | Oswald | 15/49.1 |
| 4,041,567 | 8/1977 | Burgoon . | |
| 4,218,798 | 8/1980 | Block | 15/49.1 |
| 4,674,142 | 6/1987 | Meili | 15/49.1 |
| 4,729,141 | 3/1988 | Berg et al. . | |
| 4,910,824 | 3/1990 | Nagayama et al. . | |
| 5,006,851 | 4/1991 | Kaneaki et al. | 341/155 |
| 5,016,310 | 5/1991 | Geyer et al. | 15/49.1 |
| 5,048,141 | 9/1991 | Hüppi | 15/49.1 |
| 5,481,776 | 1/1996 | Briscoe | 15/49.1 |

FOREIGN PATENT DOCUMENTS

| | | |
|---|---|---|
| 0 173 394 | 3/1986 | European Pat. Off. . |
| 0 391 457 | 10/1990 | European Pat. Off. . |
| 33 09 967 | 9/1984 | Germany . |
| 1 388 557 | 3/1975 | United Kingdom . |

*Primary Examiner*—Tony G. Soohoo
*Attorney, Agent, or Firm*—Young & Thompson

[57] ABSTRACT

Cleaning or sweeping apparatus for example of the pedestrian type, has a suspension and preferably means for biasing the brush or brushes against the surface to be cleaned or swept, at a desired value and preferably at a controllably variable value. Long springs mounted in spring tubes which are compressed by an electrical actuator are the preferred option. Working pressures are measured and displayed on an operator's console and may be kept fairly constant despite uneven floors by a feedback control circuit. An operator may input a desired pressure and feedback can be used to tailor the working pressure to the chosen pressure input. An electronic control circuit included a microprocessor is described. With a controllable brush pressure the cleaning or sweeping machine is more adaptable, can be used for both heavy duty cleaning or scrubbing tasks and light sweeping tasks without the need to for resetting the machine in the factory and without wearing out the expensive brushes or damaging the floor surface.

14 Claims, 5 Drawing Sheets

BRUSH PRESSURE SYSTEM

FIELD OF THE INVENTION

The present invention relates to a brush pressure system and is particularly applicable to floor cleaning or sweeping apparatus and machines using rotating brushes for example to scrub and/or sweep and/or polish a floor surface.

BACKGROUND OF THE INVENTION

Known floor cleaning machines use rotating brushes to scrub or polish a floor. The brushes are mounted on a wheeled frame which is pedestrian controlled or in larger models is ridden on by the operator. Pressure on the brushes for cleaning or sweeping is provided by the weight of the brush heads and motor assemblies in combination with the weight of the water tanks. However in known machines only a particular fixed pressure can be applied; there is no provision for a variety of pressures to be chosen to suit different cleaning or sweeping tasks, or different floor types. Although pressures of up to 200 lbs. pressure can be achieved with the known pedestrian machines, this may not be adequate for heavy duty cleaning on very contaminated floors and is often too high a pressure for normal maintenance cleaning. If the brush pressure is high then the brushes wear down very quickly. The sort of brushes used in this equipment are very expensive and excessive wear is unacceptable. In any case, excessive prolonged brush pressure may damage certain floor surfaces. On the other hand, if the brush pressure is too light then the cleaning machine will not be effective on heavily soiled floors. In addition as brushes wear down the effective cleaning pressure necessarily decreases and hence the cleaning power is less satisfactory.

Some recent pedestrian machines have tried to compensate for brush wear by incorporating small springs into the brush heads so as to take up the wear in the brushes. These however have been found to be unacceptably unreliable in many circumstances because the springs have a tendency to lock over rough surfaces and this causes damage to the driving motors. In any case, in known machines, the maximum pressure is limited and there is no way of adjusting the pressure to be applied by the brushes.

Furthermore, known machines make no allowance for uneven ground and tend to malfunction unless the floor to be cleaned is smooth and flat. Also, since known machines rely for the applied pressure on the weight of part of the machine such as the water tanks and such like, then they are difficult and heavy to operate and maneuver and this makes them difficult for example for less strong operators such as women to use.

The present invention seeks to provide a cleaning or sweeping apparatus which does not have the disadvantages of previously known apparatus.

SUMMARY OF THE INVENTION

According to one aspect of the present invention there is provided a cleaning or sweeping apparatus comprising:

a frame;

a brush assembly mounted on the frame;

means for moving the brush assembly towards and away from a surface to be brushed; and resilient biasing means mounted to act as suspension means between the frame and the brush assembly.

According to preferred embodiments, the brush pressure can be varied by controlling the biasing means, for example by controlling tension in a spring means or pressure in a gas strut or volume of fluid in a hydraulic or pneumatic system. An actuator can be used to control this tension, for example by compressing the spring means; the greater the compression the greater the brush pressure on the floor and the more effective the cleaning power of the machine. The actuator is preferably an electrically driven ram though it could be hydraulically or even manually driven.

The extent of the bias, e.g. the spring tension, and thus the pressure, may be set in the factory when the cleaning or sweeping machine is manufactured or by a service engineer when the cleaning or sweeping machine is serviced to suit a particular cleaning task. According to a particularly preferred embodiment, the pressure is adjustable by the operator in situ to suit the task being performed. For light cleaning or polishing, a light pressure is preferable and minimises brush wear, whereas for heavy cleaning on highly contaminated floors, more pressure is needed. Preferably means are provided for entry and display of a desired pressure by an operator, and for adjusting the applied pressure accordingly.

According to one preferred embodiment of the first aspect of the present invention at least one spring is mounted in a spring tube which is driven by an actuator controlled for example by a two-position rocker switch on the machine's control panel. The rocker switch would for example be biased to an intermediate off-position and be rocked one way to increase pressure and the other way to decrease pressure. Releasing the switch would therefore return it to the neutral or "off" position thus stopping movement of the actuator.

Preferably a pair of springs is used, each spring being mounted in a spring tube, and both driven by a common actuator controlled by such a rocker switch.

According to a second aspect of the invention there is provided a cleaning or sweeping apparatus comprising:

a frame;

a brush assembly mounted on the frame for movement towards and away from a surface to be brushed;

a biasing means acting between the frame and the brush assembly to apply to the brush assembly a bias towards the surface;

means for measuring the pressure exerted by the brush assembly on the surface; and means for displaying the measured pressure.

The brush pressure is measured either by mechanically measuring the compression of the springs or by a strain gauge or pressure transducer or piezoelectric sensor. The pressure can then be displayed on a control panel alongside the switch for the operator's information.

According to another embodiment of the invention, feedback is used to control the brush pressure, e.g. the spring compression, as a function either of the pressure measured to maintain the applied pressure substantially constant or at least within set margins, or of the pressure required and which is set by an operator.

According to another aspect of the invention there is provided a sweeping or cleaning apparatus comprising:

a frame;

a brush assembly mounted on the frame;

means for moving the brush assembly towards and away from a surface to be cleaned;

biasing means acting between the frame and the brush assembly to apply to the brush assembly a selectable bias towards the surface;

means for monitoring and/or measuring the applied working pressure;

means for displaying an indication of the measured working pressure;

means for operator entry of a desired working pressure for the brush assembly.

Preferably the apparatus comprises comparator means for comparing the operator input pressure to the measured pressure and for generating a control signal in response to the difference between the desired pressure and the measured pressure and means for applying the control signal to the pressure applying means.

The apparatus can be used in single brush head cleaning machines or more usually in a dual head machine or also multiple head models either by being applied in common to all heads or independently to each head.

Cleaning and sweeping machines generally use round or elliptical shaped brushes mounted to rotate in a plane generally parallel with the floor. The bristles of the brushes are all set generally perpendicular to the surface to be cleaned or swept. However, it is envisaged that the brush pressure system of the present invention would be equally applicable to a cleaning or sweeping machine with a cylindrical brush head with bristles radially mounted and which rotates about an axis parallel to the surface to be cleaned or swept. In this case it would be preferable to mount an apparatus according to the invention to apply pressure equally at each end of the cylindrical head shaft.

In one preferred embodiment which is particularly applicable to a pedestrian machine, the biasing means comprise at least one heavy duty compression spring at least 3 ins (7.2 cm) and preferably 6 ins (14.4 cm) long and advantageously 12 to 15 ins (28.8 to 36 cm) long (though they may be longer). The required length of the spring will of course depend on many factors, including for example the type of machine (longer springs will be needed in a ride-on machine), the gauge of the spring (heavy duty springs need to be longer than light duty springs to provide the required suspension characteristics to compensate for uneven ground), the cleaning or sweeping power required and the relative positions of the actuator and the spring tubes. A single spring could be used or alternatively two or three springs totalling the required length could be mounted in the spring tube. Alternatively a torsion spring could be used.

In order to minimise brush pressure variation despite brush wear or uneven floors or surfaces then the biasing means preferably comprises a low rate spring such as a torsion spring. Preferably the pressure is applied by the low rate spring movement and the actuator control is applied to the other end of that spring.

A suitable low rate spring means could alternatively comprise a gas strut, though preferably also an adjustable mechanical advantage to provide effective control means.

Brush pressure can also be altered by changing the springs though obviously this is not something that can be done easily by the operator on site and would instead usually by done by a service engineer or similar person.

A cleaning or sweeping system incorporating apparatus according to the present invention has considerable advantages over any known system. It can achieve high brush pressures allowing for heavy cleaning of contaminated floors. Systems can also achieve light brush pressure thus allowing light cleaning with the same machine if and when desired, thus minimising unnecessary brush wear and avoiding damage to floors or surfaces to be cleaned which often occurred with the indiscriminate pressure setting on known systems. Apparatus according to the invention provides good suspension for a cleaning or sweeping machine allowing for a floating cleaning or sweeping head and enabling a machine to go over rough or uneven surfaces without malfunctioning.

A cleaning or sweeping machine incorporating an apparatus according to the invention can be easily used and controlled even by a relatively physically weak operator, and provides more cleaning or sweeping power than was hitherto possible in pedestrian machines.

According to a further aspect of the present invention there is provided a system for controlling a cleaning or sweeping apparatus, the system comprising means for applying any one of a variety of working pressures to a cleaning or sweeping brush assembly in a cleaning or sweeping apparatus, means for monitoring and/or measuring the applied working pressure and means for displaying an indication of the measured working pressure. The displaying means is preferably a digital LED or LCD display. If the actuator controlling the working pressure is hydraulically, pneumatically or hand operated then a pressure indicating signal can be provided from a direct mechanical link such as a Bowden cable or rotational drive connection.

According to a preferred embodiment of the further aspect of the invention, there is provided a system comprising input means for the operator to set the desired working pressure and comparator means for comparing the operator input pressure to the measured pressure and for generating a control signal in response to the difference between the desired pressure and the measured pressure and means for applying the control signal to the pressure applying means.

This enables an operator to control cleaning head pressure and thus to have control over the cleaning power of the machine and the rate of brush wear.

Preferably an electronic processor is provided to serve as the comparator means. The pressure measuring means may register pressure through an electronic resistive element and display the measured value on the operator's console.

Preferably the brush pressure exerted by the brush head is measured directly, for example by measuring the torque directly at the brush head so that a constant brush pressure can be maintained, and the pressure can be read back to a gauge showing pressures on the operator display panel.

According to a particular embodiment of the further aspect of the present invention there is provided a control system for brush head pressure in a cleaning or sweeping machine, the control system comprising analogue to digital conversion means for converting input signals representing respectively a measured brush head pressure and an operator chosen brush head pressure, storage means for predetermined system parameters, and computing means programmed to compare the two input signals and to generate a control signal in response to the comparison, taking into account the predetermined system parameters.

Preferably the measured pressure signal is amplified before conversion to a digital signal.

In a particular preferable embodiment means are provided for sensing the state of a power supply source such as a battery or battery pack and for generating a signal for inhibiting brush operation when the state is below a preset value. Additionally accumulation means may be provided to record the total usage time of a power source and to generate a signal to inhibit brush operation when the usage time exceeds a preset value.

In one embodiment, the control system is arranged to inhibit brush pressure changes if the cleaning machine is moving.

The cleaning or sweeping apparatus according to the invention may be used to clean or sweep any surface for example floors, pavements, roads and even non-horizontal surfaces such as ramps and walls.

BRIEF DESCRIPTION OF THE DRAWINGS

For a better understanding of the invention and to show how the same may be carried into effect, reference will now be made to the accompanying drawings in which.

DETAILED DESCRIPTION OF THE INVENTION

Figure 1:
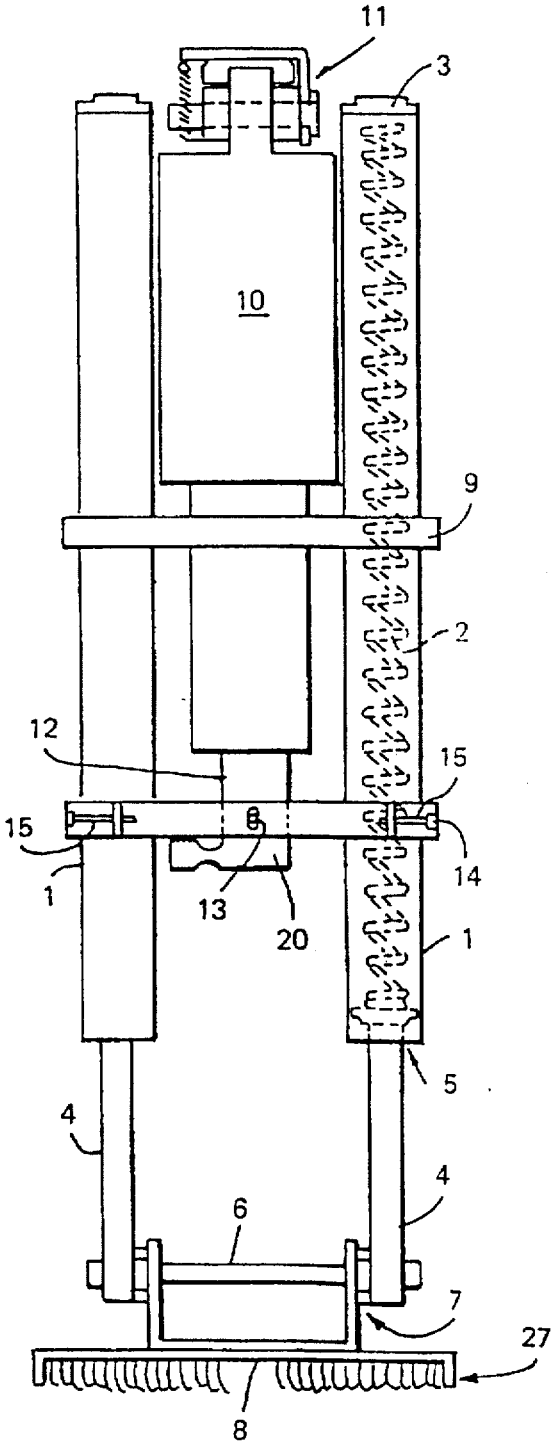
FIG. 1 shows a cross-section elevational view of brush assembly for a cleaning apparatus according to the invention.

In FIG. 1, the brush assembly comprises two spring tubes 1, containing springs 2. The right hand tube 1 in the figure is shown in cut-away to illustrate spring 2. Each spring is fixed at one end to the upper end of the tubes at 3 and at the other end to a spring rod 4 which slides through an aperture 5 into the respective spring tube 1. The spring rods 4 are connected together by a bolt 6 and are fixed via assembly 7 to the brush support plate 8 to which brush head or heads 27 are connected.

The tubes 1 are prevented from rotating or skewing by a steadying plate 9. An actuator 10 is secured to a bulkhead of a cleaning machine. Actuator 10 drives actuator rod 12 which is shown in substantially closed up position in the figure. The actuator rod 12 is fixed by a pin 13 to actuator plate 14 which is clamped to both spring tubes 1 by clamping bolts 15. Thus as the actuator drives the actuator rod 12 downwards, the spring tubes 1 move downwards and the springs 2 are compressed causing a higher pressure to be exerted on the brush head assembly whilst still providing suspension to accommodate uneven floors and brush wear. Typically, the effective spring lengths, in an uncompressed state, are around 15 inches and this is particularly suitable for a 26/32 inch brush pressure system. Such an arrangement can provide a range of 0 to 450 lb pressure in a loaded pedestrian cleaning machine fitted with apparatus according to the invention, compared to the maximum 200 lb pressure available using known apparatus. Of course other forms of biasing means could be used. A torsion spring has the advantage of taking up less vertical space in a cleaning machine. Also, a torsion spring generally has a low spring rate which is particularly suitable for this purpose. Gas struts or hydraulic or pneumatic systems could also be used.

The pressure can be further adjusted by changing the springs for different length ones or different strengths the clamping position of the spring tubes can be altered. However these changes require a service engineer.

The system is particularly adjustable since the actuator can be stopped anywhere in its stroke.

Usually brush support plate 8 will be attached to a pair of circular or elliptical brushes rotating in a plane generally parallel to the floor (or surface to be cleaned or swept). However, up to four brushes are in use in some cleaning machines and the apparatus of the invention could be used to control all such four brushes together or alternatively individually (in which case separate actuators would be used for each). Of course a cylindrical brush head could be equally easily controlled mounted on the brush support plate 8 or alternatively controlled at each end of its shaft by respective separate assemblies according to FIG. 1.

A strain gauged beam 20 which may be used to measure the brush pressure is located under the spring tube clamp plate 18.

Figure 2:
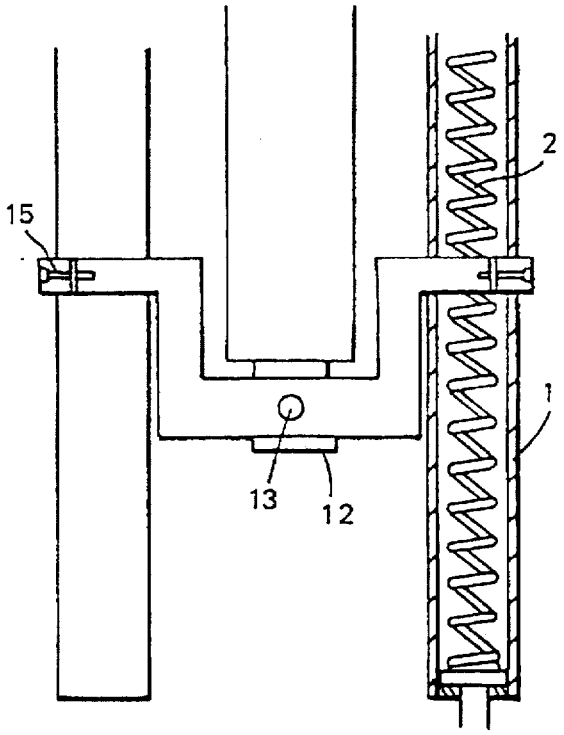
FIG. 2 shows an alternative arrangement of part of the assembly of FIG. 1

FIG. 2 illustrates an alternative arrangement of the actuator plate 14 wherein the plate has a U-shaped cross section as shown so that it is clamped to the spring tubes 1 in a plane spaced from that in which it is clamped to the actuator rod 12. This arrangement enables particularly low brush pressures to be achieved even with heavy duty springs.

Figure 3:
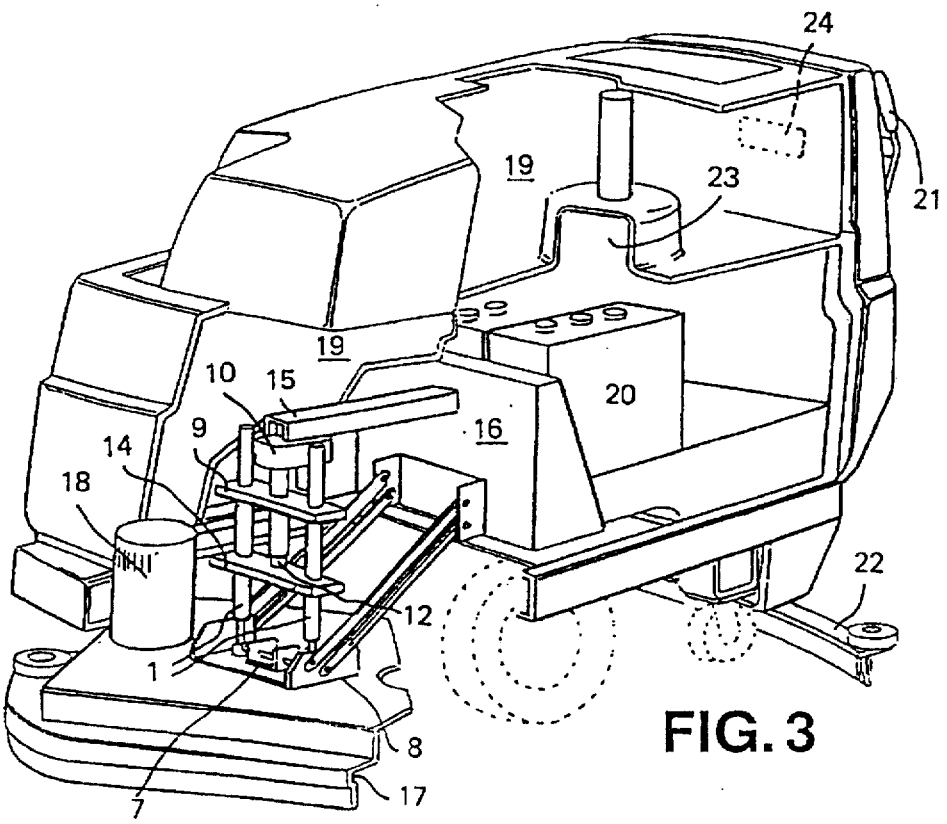
FIG. 3 is a part cut-away perspective view of a cleaning apparatus incorporating the assembly of FIGS. 1 and 2.

In FIG. 3 the brush assembly of FIG. 1 is shown mounted in a pedestrian cleaning apparatus. Like parts are indicated by like reference numerals and a pair of spring tubes 1 are attached to actuator rod 12 by actuator plate 14. The actuator 10 is fixed by tie bar 15 to the apparatus frame 16. A second pivoted mounting 17 connects the assembly 7 and brush support plate 8 to frame 16. The brushes themselves are not shown in FIG. 3 but are mounted below the support plate 8 behind the protective flange 17 and are driven by scrub brush motors 18 (one of which is shown in FIG. 3).

FIG. 3 also illustrates the relative positions of the water tank or tanks 19, the battery pack 20 for driving the scrub motors 18 together with the transverse drive of the cleaning apparatus. The direction of transverse drive is controlled by a handle 21. A squeegee 22 has suction applied via vacuum motor 23.

Additionally a brush head pressure control panel 24 is provided within the operator's view.

Figure 4:
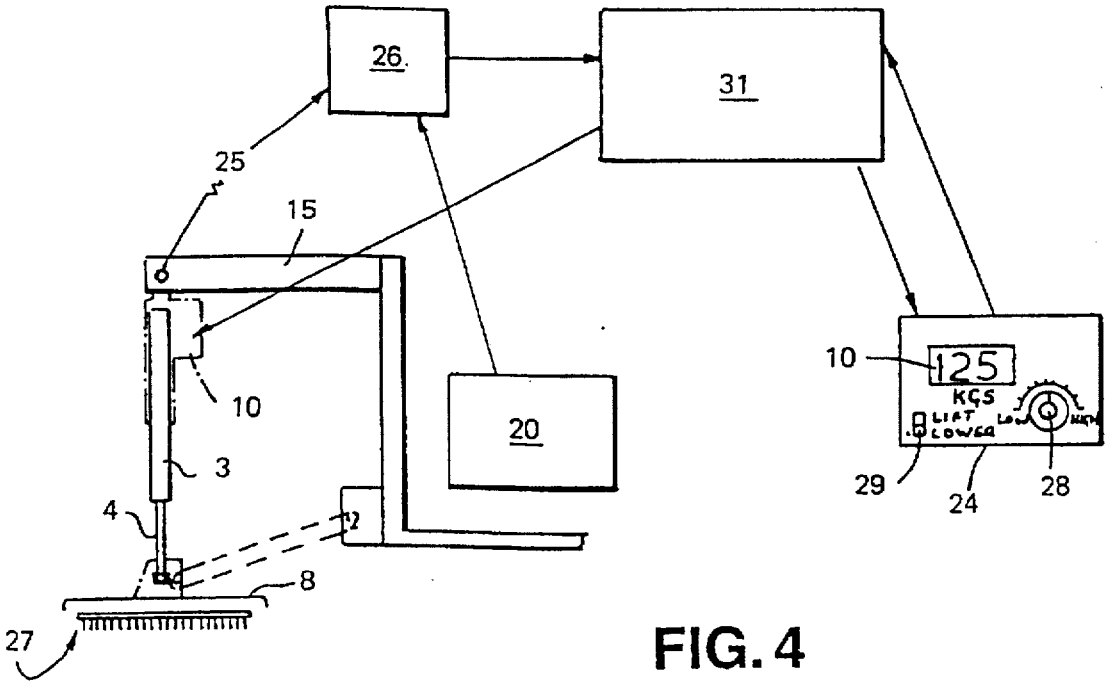
FIG. 4 is a diagrammatic representation of a control system for a cleaning apparatus according to FIGS. 1 to 3.

In FIG. 4 the brush assembly is shown schematically in side view and a control system is illustrated as a block diagram.

The position of the brush head 27 relative to the floor to be cleaned, is controlled by electric or hydraulic actuator 10 lifting or lowering the brush head via an actuator rod which compresses springs in spring tube 1. Other resilient means such as a gas strut may be used for applying pressure to the brush head against the floor and of course other means may be used to control the position of the brush head such as hydraulic or pneumatic means. Details of the actuator 10 has been described above.

A pressure sensor is located at one of the positions labelled 4 though it may be positioned anywhere in the cylinder or in the arm or in the bottom of the actuator. In use this sensor monitors the pressure applied by the brush to the floor and generates a signal 25. The pressure sensor may be a strain gauge 20 on actuator plate 14 as shown in FIG. 1 or a piezoelectric sensor or position sensor. Alternatively the securing pin (11 FIG. 1) which connects the assembly to the apparatus frame, may be used as a shear gauge to measure pressure. Amplifier 26 converts this pressure signal 25 to a value usable in the subsequent circuitry.

The control panel 24 is provided within sight of an operator. It has a pressure select knob 28 by which the operator can pre-select a particular pressure. A rocker switch 29 lifts or lowers the brush head 27 relative to the floor depending on the switch position. A digital display 30 illustrates the pressure of the brush head 27 on the floor, as measured by the pressure sensor.

A processor 31 compares the measured pressure signal with the operator selected pressure and generates a control signal accordingly to control (as necessary) the actuator to make the measured pressure substantially the same as the selected pressure.

This processor may be of simple construction such as comprising an electronic comparator and amplifier circuit, or it may comprise a standard CPU unit in chip form.

Power for the electronic components is supplied by the on-board battery 12 or by alternative low power battery sources.

Figure 5A:
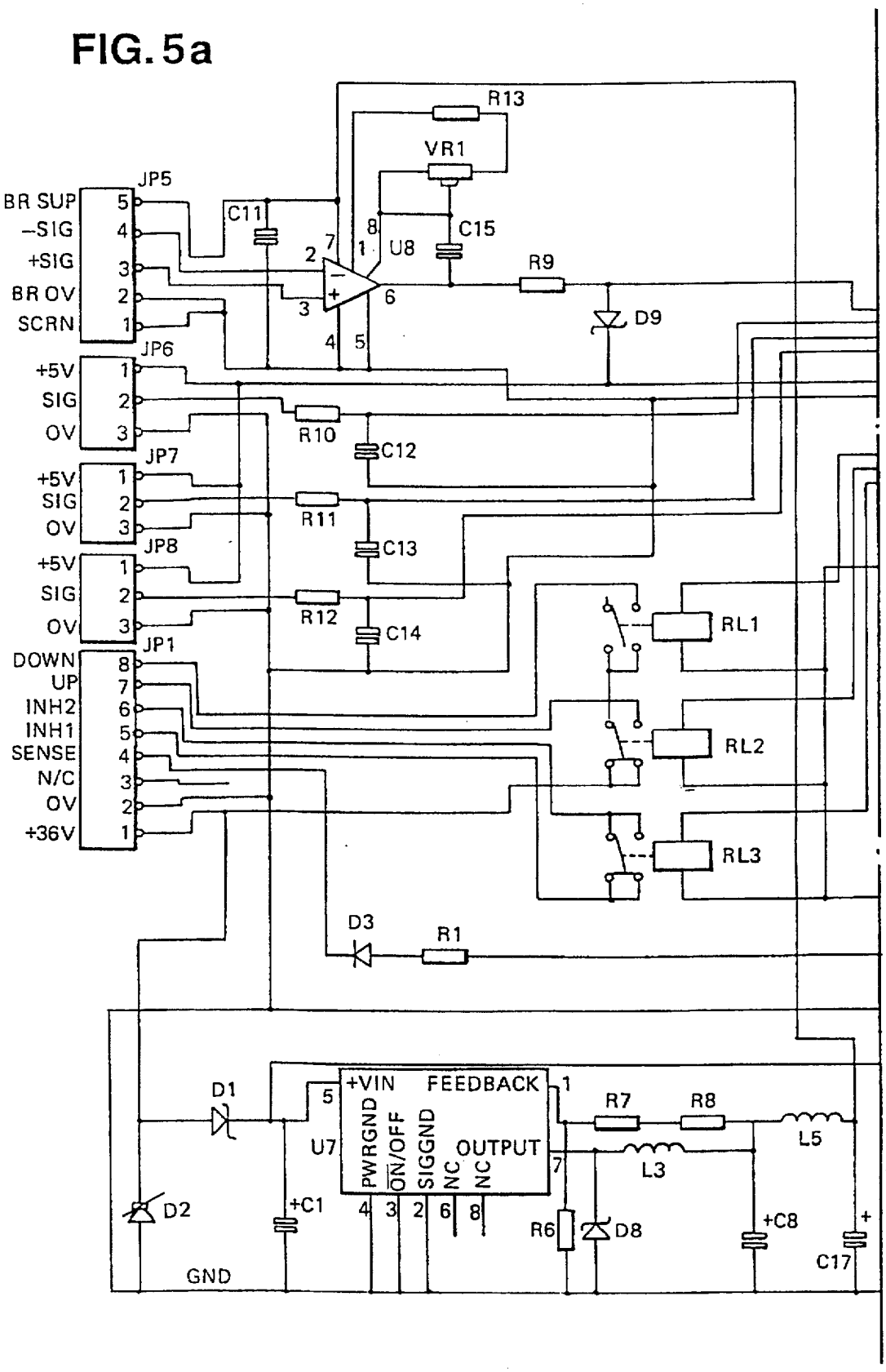
FIG. 5*a*–5*c* is a circuit diagram illustrating one embodiment of the control system of FIG. 4.
Figure 5B:
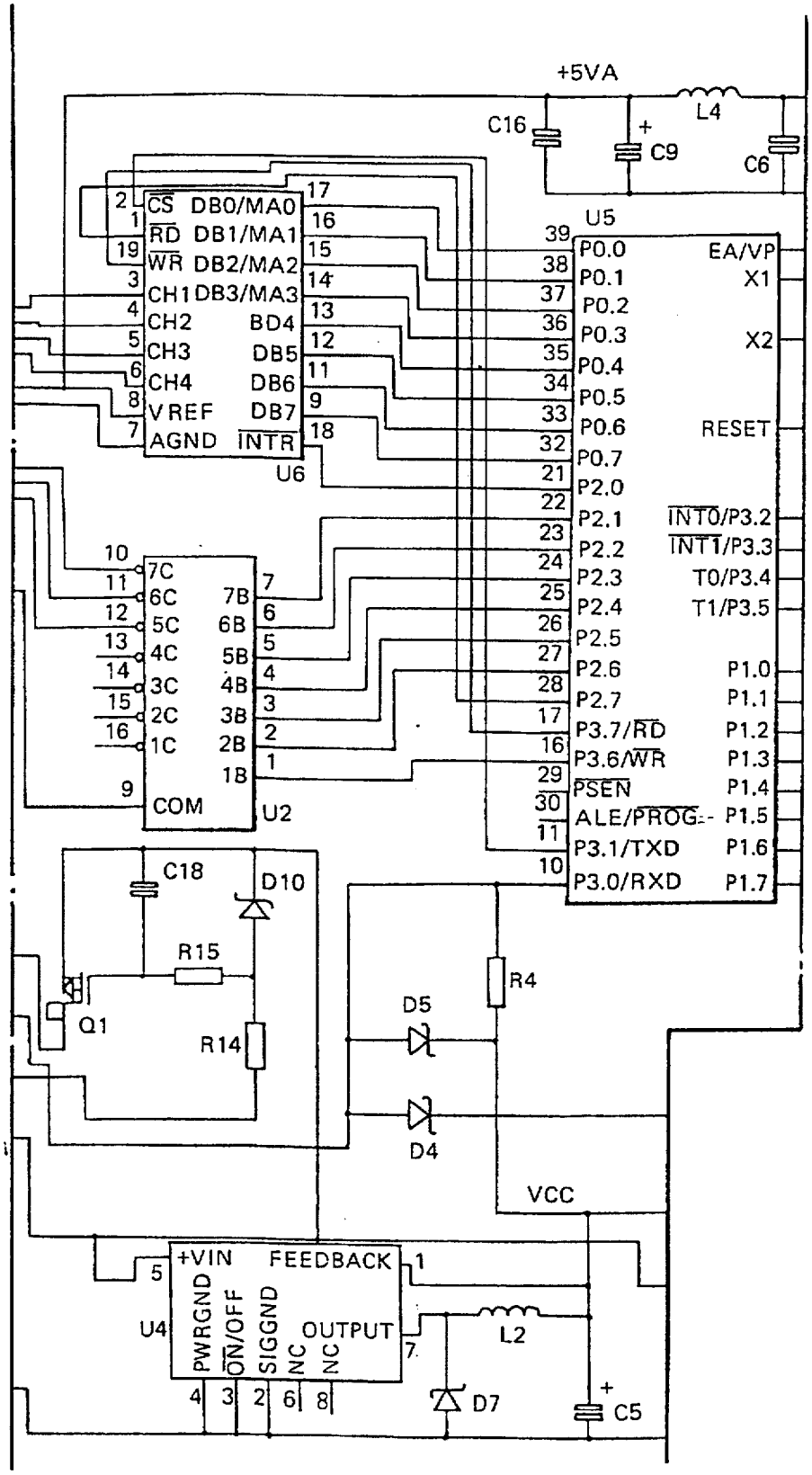
Figure 5C:
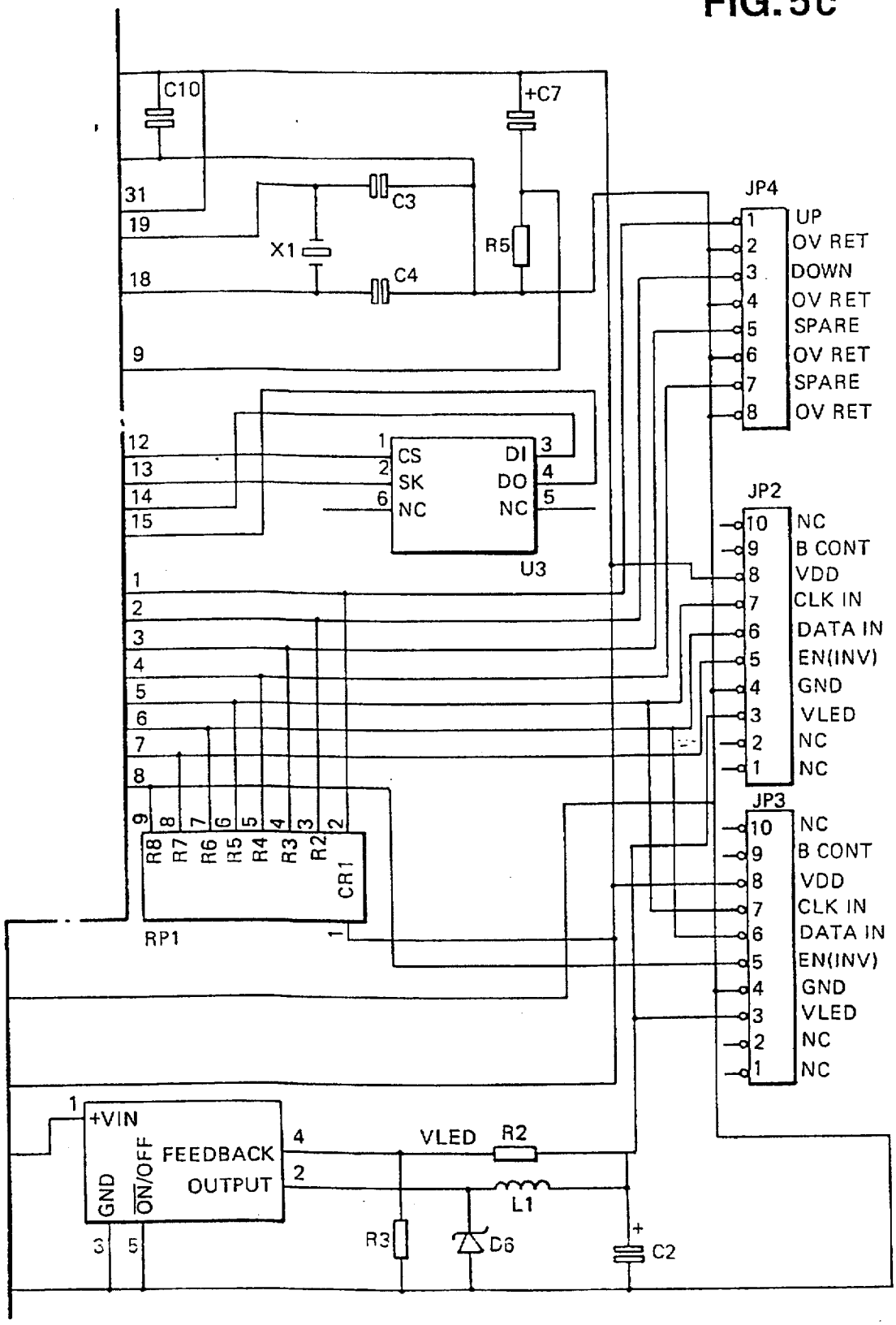

The circuit of FIG. 5 can be used as the control system for the system. It comprises standard integrated circuits including a programmed micro-controller or micro-processor U5, power supply IC's U1, U4 and U7, non-volatile memory store U3, analogue to digital converter U6 and buffer amplifier U2.

A measured pressure signal from a pressure bridge or strain gauge mounted in the cleaning head is input to the microprocessor U5 via instrumentation amplifier U6 and analogue to digital converter (ADC) U6.

System variables are stored in the non-volatile memory store U3.

The state of external switch inputs on the cleaning machine are sampled via buffer JP4.

The microprocessor U5 makes appropriate calculations based on the sampled values and the set system variables and outputs control signals via buffer amplifier U2, relays RL1, RL2 and RL3 and buffer JP1 to contact relays to operate the actuator on the cleaning machine itself. For example, when relay RL1 is tripped 36 volts are applied to the cleaning head lowering actuator, when relay RL2 is tripped 36 volts are applied to raise the cleaning head, and when relay RL3 is tripped the drive control or traction of the cleaning machine is inhibited. A further relay may optionally be provided to inhibit the brush motor under certain predetermined circumstances—such as when the battery is low to protect the warranty on the battery.

The SENSE input on buffer JP1 senses whether or not the cleaning machine is moving. If it is, then the circuit inhibits pressure changes to avoid damaging the brushes.

Buffers JP2 and JP3 supply signals to the machine control panel to display the actual measured pressure indication and the set value indication respectively on LED displays.

The circuit comprising MosFet Q1, resistors R14, R15, together with diode D10 and capacitor C18 is a power-up hold off circuit to prevent the relays pulsing during switching to avoid spurious operation of the actuator. This is optional and can be accomplished in a number of different ways as will be immediately apparent to anyone skilled in the art.

Circuits JP6 and JP7 are unused as shown.

Further modifications can be included in this circuit, for example a battery monitor could advantageously be incorporated to record the total usage time and monitor the charge state of the battery. Under certain predetermined conditions, as programmed into the system parameter memory circuit U3, the cleaning brushes would be automatically raised. Such conditions would typically be long battery usage and/or low battery charge. The operator would then necessarily have to take the machine back to the depot to recharge or replace the battery thus preserving the warranty on the battery.

The control circuit of the invention is very finely tunable and achieves extremely accurate pressure settings for the brush head.

The micro-controller U5 is preferably programmed to always effect pressure changes in a direction such that the brushes are moved downwardly and this aids the accuracy of the settings. For example, if a change in pressure from 100 lbs to 40 lbs is required by an operator, the controller will cause a jump to a value around 20 lbs and then slowly increase the pressure up to the required value of around 40 lbs. This arrangement overcomes stiction in the machine. It is particularly advantageous if phase advance calculations are also used by the micro-controller such that the micro-controller calculates the speed at which the pressure changes are occurring and makes appropriate adjustments.

The circuit also preferably monitors the state of the external brush head raise/lower switch and the microprocessor U5 can be programmed to take the state of this switch into account in making decisions on whether to effect certain operations.

I claim:

1. A sweeping or cleaning apparatus comprising:

a frame;

a brush assembly connected to the frame via biasing means;

means for moving the brush assembly towards and away from a surface to be cleaned;

said biasing means acting as a suspension between the frame and the brush assembly to apply to the brush assembly a selectable bias towards the surface;

means for monitoring and measuring the applied working pressure;

means for displaying an indication of the measured working pressure;

means for operator entry of a desired working pressure for the brush assembly and comparator means for comparing the operator desired working pressure to the measured pressure and for generating a control signal in response to the difference between the desired working pressure and the measured pressure and means for applying the control signal to the pressure applying means.

2. An apparatus as claimed in claim 1, wherein the biasing means comprises an actuator having a first member and a second member extendable therefrom by a selectable amount, the brush assembly being connected to the second member.

3. An apparatus as claimed in claim 1, wherein the biasing means comprises a sleeve secured to the second member, a rod having an inner end slidable within the sleeve, the rod projecting from the sleeve and connected to the brush assembly, and a spring within the sleeve engaging the inner end of the rod.

4. Apparatus according to claim 1, wherein the displaying means comprises means to display a digital value of the applied pressure.

5. Apparatus according to claim 1, wherein the pressure measuring means comprises a strain gauge.

6. Apparatus according to claim 1, wherein the pressure measuring means comprises a pressure transducer.

7. Apparatus according to claim 1, wherein the pressure measuring means comprises a piezoelectric sensor.

8. Apparatus according to claim 1 comprising a rocker switch having a first position to actuate means operatively associated with the brush assembly for increasing brush pressure and second opposite position to actuate means operatively associated with the brush assembly for decreasing pressure, and means for biasing the rocker switch to an intermediate off position.

9. Apparatus according to claim 1 comprising feedback means controls the applied brush pressure as a function of the measured pressure in order to maintain the applied pressure at a value substantially within preset boundary values.

10. Apparatus according to claim 1, wherein the comparator is comprised of an electronic processor.

11. Apparatus according to claim 1, further comprising means for controlling brush head pressure, having:

analogue to digital conversion means for converting input signals representing respectively a measured brush pressure and an operator chosen brush pressure;

storage means for predetermined system parameters;

computing means programmed to compare the two input signals and to generate a control signal in response to the comparison and the predetermined system parameters;

means for receiving the control signal and for controlling the brush head pressure in dependence thereon.

12. Apparatus according to claim 11 comprising a power supply source, means for sensing a state of said power supply source for the cleaning or sweeping apparatus and means for generator a signal for inhibiting brush operation when the battery state is below a preset value.

13. Apparatus according to claim 12 comprising memory means for recording an accumulation of the total usage time of the power source and to generate a signal to inhibit brush operation when the usage time exceeds a preset value.

14. Apparatus according to claim 11 comprising means to change operator input brush pressure, and means to inhibit change of said operator input brush pressure when the cleaning apparatus is traversing a surface to be cleaned.

* * * * *